US010668599B2

(12) United States Patent
Corcoran

(10) Patent No.: US 10,668,599 B2
(45) Date of Patent: Jun. 2, 2020

(54) CLAMPING APPARATUS

(71) Applicant: Power Box AG, Zug (CH)

(72) Inventor: Michael Corcoran, Somerset (GB)

(73) Assignee: Power Box AG, Zug (CH)

( * ) Notice: Subject to any disclaimer, the term of this patent is extended or adjusted under 35 U.S.C. 154(b) by 53 days.

(21) Appl. No.: 15/484,884

(22) Filed: Apr. 11, 2017

(65) Prior Publication Data

US 2017/0291282 A1 Oct. 12, 2017

(30) Foreign Application Priority Data

Apr. 12, 2016 (GB) ..... 1606276.2

(51) Int. Cl.

| | |
|---|---|
| ***B43L 5/00*** | (2006.01) |
| ***B25B 1/16*** | (2006.01) |
| ***B25B 1/24*** | (2006.01) |
| ***B25B 1/02*** | (2006.01) |

(52) U.S. Cl.

CPC ..... *B25B 1/16* (2013.01); *B25B 1/02* (2013.01); *B25B 1/24* (2013.01)

(58) Field of Classification Search

USPC ..... 269/90, 86, 159, 210, 211

See application file for complete search history.

(56) References Cited

U.S. PATENT DOCUMENTS

| | | | | | |
|---|---|---|---|---|---|
| 1,111,185 | A * | 9/1914 | Schmidt | B25B 1/06 | 269/159 |
| 2,892,369 | A * | 6/1959 | Millet | B25B 1/16 | 269/159 |
| 4,475,727 | A * | 10/1984 | Goulter | B25H 1/10 | 269/154 |
| 5,524,872 | A * | 6/1996 | Lewin | B25B 1/06 | 269/158 |
| 6,299,152 | B1 * | 10/2001 | Sangmeister | B25B 1/2405 | 269/139 |
| 8,276,895 | B2 * | 10/2012 | Brown | B23K 37/0435 | 269/45 |

* cited by examiner

*Primary Examiner* — Joseph J Hail
*Assistant Examiner* — Shantese L McDonald
(74) *Attorney, Agent, or Firm* — Gable Gotwals

(57) ABSTRACT

The invention relates to clamping apparatus for a workpiece. The apparatus includes first and second jaws, one of which is movable by operator operation of a lever assembly and locking means are provided to selectively lock the movable jaw in position. The locking means can be actuated by the operator's foot thereby leaving the operator's hands free to perform work on the workpiece. An engagement system is also provided in order to allow additional accessory components to be selectively fitted to the apparatus for use in particular work operations.

20 Claims, 9 Drawing Sheets

CLAMPING APPARATUS

CROSS-REFERENCE TO RELATED APPLICATIONS

Figure 1A:
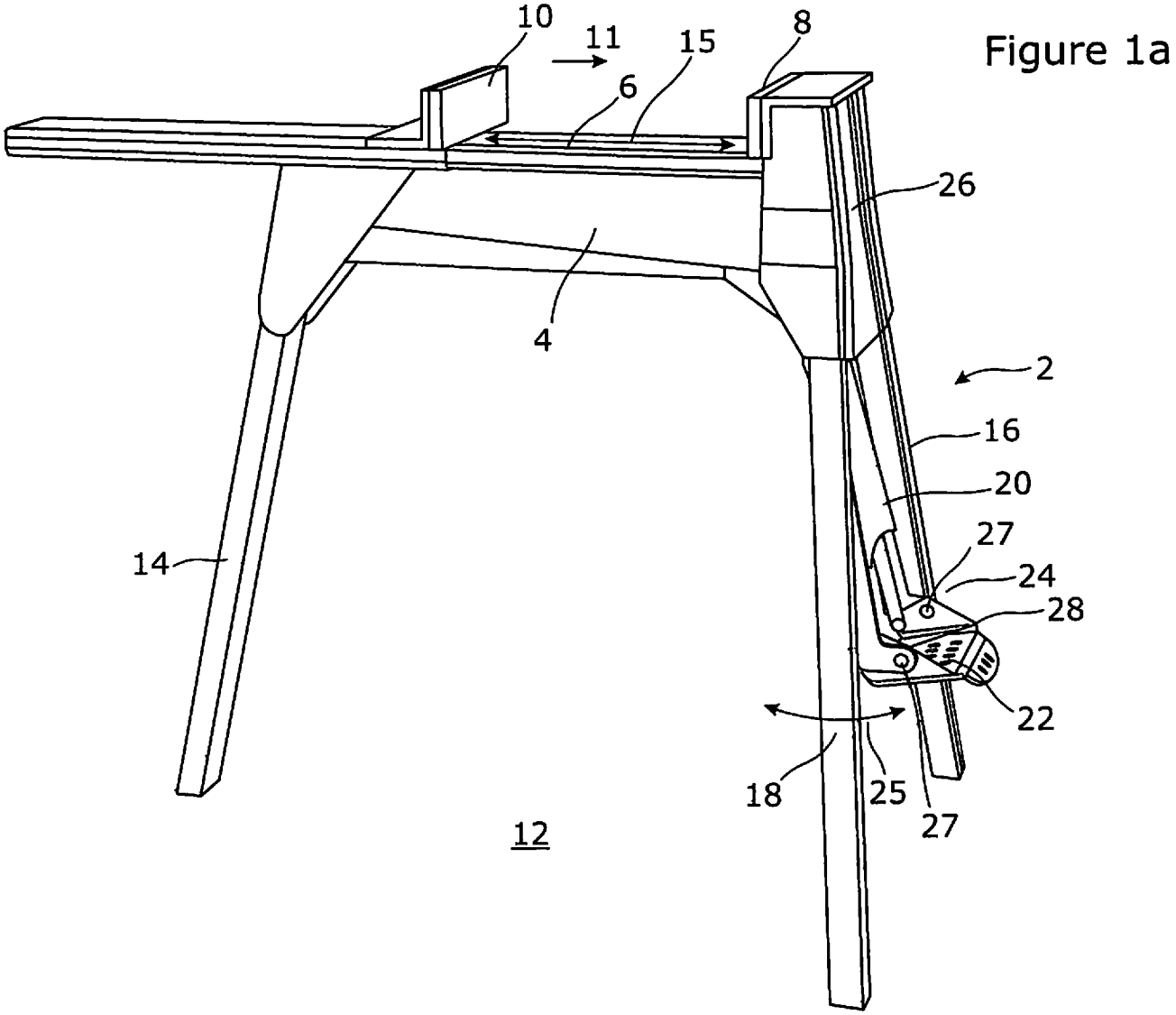

This application claims priority to British Patent Application No. 1606276.2 filed 12 Apr. 2016, which is incorporated herein by reference.

BACKGROUND OF THE INVENTION

The invention to which this application relates is to a clamping apparatus which includes a vice with at least a pair of clamping jaws between which one or more workpieces can be clamped to allow an operator to perform work on the workpiece.

Typically the jaws are provided on a support body frame which is of a height so as to allow the jaws, and the workpiece held by the same, to be located at a height which is suitable for the operator to work on the workpiece while standing.

One known form of clamping device is shown in the European Patent EP0573501 which discloses a portable apparatus which can be moved between a collapsed condition for storage and transport and an erect condition for use in holding a workpiece.

The operation of the clamping device shown in this patent has a support body and allows one of the jaws to be moved towards and away from the other fixed jaw so as to be located in a clamping position within a range of possible clamping positions on a workpiece located between the jaws and on the support body. The movement of the jaw is achievable by the operator operating a pedal mechanism connected to the jaw and the movement of the foot pedal causes the said jaw to be moved towards the fixed jaw. When the jaw is in the required position, the operator then moves a locking assembly switch provided on the support body to a locked position to lock the jaw in that position. The locking assembly switch is positioned on the support body so that it is required to be operated by a hand of the operator sliding the same to a locked position when required and when the jaw is required to be moved away from the fixed jaw the locking assembly switch is required to be slid by the operator's hand to the unlocked position.

While this form of device has been found to be commercially successful and beneficial to operators for a wide range of uses, there are known to be problems which are experienced by the operator. One of these problems relates to the fact that in the current operating system the movement of the jaw towards the fixed jaw is performed by the foot movement of the pedal but the locking assembly for the position of the jaw is a separate mechanism which is required to be operated by hand. This therefore means that it is possible for the operator to forget to operate the separate lock mechanism and also means that the operator is required to have a free foot and hand in order to be able to operate both the movement and locking mechanisms whilst also potentially having to support the workpiece in position with their other hand whilst the movable jaw is locked in position. This can on occasions be difficult and potentially hazardous for the operator to achieve.

A further problem is that, although the apparatus of the known type can be used for a number of different purposes and with a number of different accessories, it can be time consuming for these accessories to be fitted into position and removed. It is found that, in practice, this can mean that frustration is caused to the operator, and/or the accessories are not used at all, which can mean that the apparatus is used in an inappropriate and potentially hazardous way.

An aim of the present invention is therefore to provide an improved lever operated clamping apparatus which is capable of increased hands-free operation. A further aim is to allow the improved fitting of accessories to and from the apparatus thereby increasing the ease of use and utility of the apparatus.

According to a first aspect of the invention there is provided a clamping apparatus which includes a support structure, at least two clamping jaws, at least one of the jaws linearly movable with respect to the other of the jaws so as to define a spacing between the same within which a workpiece can be held in position by the jaws, a lever assembly pivotally connected to the support structure and provided to be pivotally moved by the operator for engaging and driving the movement of the said movable jaw to apply a clamping force to the workpiece positioned between the jaws, and locking means for locking the at least one movable jaw in an operator selected position, and wherein the locking means is actuable by the operator contacting a locking means actuator via their foot.

In one embodiment the locking means actuator is provided as part of the lever assembly which is also actuable via the operator's foot. Typically the contact with the lever assembly is via the operator placing their foot on a pedal provided as part of the lever assembly.

In one embodiment the locking means actuator is pivotally movable with respect to the lever assembly so as to allow the selective locking of the position of the movable jaw when the actuator is moved in a first direction, and the unlocking of the position of the movable jaw when the actuator is moved in a second direction.

Most typically the second direction is opposite to the first direction.

In one embodiment the said locking means actuator and the foot pedal of the lever assembly are mounted with respect to the apparatus so as to be operated by the same foot of the operator.

Typically the locking means actuator and the pedal of the lever assembly foot can be operated when the operator is standing at the apparatus to use the same.

In one embodiment the locking means actuator is provided separately to the foot pedal of the lever assembly.

Preferably the said locking means actuator is formed integrally with the foot pedal.

In whichever embodiment, when the locking means is moved to the locking position it prevents the pivotal movement of the lever assembly and therefore prevents movement of the movable jaw until the locking means is released.

In this embodiment the foot pedal includes a portion for contact by the operator's foot to cause the lever assembly to be pivotally moved to move the at least one jaw, and the locking means actuator is formed as a portion located at an edge of the foot pedal and said portion includes a first surface to be contacted to lock the locking means and a second surface to be contacted to unlock the locking means.

Typically the first surface of the locking means actuator is provided to be contacted by the operator's toes to move the same in a first direction and the second surface of the locking means actuator is provided to be contacted by the operator's heel to move the same in an opposite direction.

Typically the foot pedal is connected to the jaws movement means by the lever assembly and the locking means actuator is connected to locking means via first and second members with which the pedal is located and which are selectively movable independently of the lever assembly.

Typically the said members extend to locking means mounted adjacent the fixed jaw.

Typically there is provided a fixed jaw and a movable jaw, and the drive means move said movable jaw towards said fixed jaw.

In one embodiment the movable jaw is mounted on, or provided as an integral part of, a carriage and it is the carriage that is moved with the movable jaw as part thereof, which is moved with respect to the support body by operation of the lever assembly when the locking means is unlocked.

In one embodiment the carriage is substantially n-shaped in cross section and receives a portion of the support body within the space defined between the carriage walls.

In one embodiment the movement of the movable jaw is as a result of operation of the lever assembly which operates a ratchet mechanism between the said carriage and the support body so as to progressively move the carriage and movable jaw towards the fixed jaw.

In one embodiment the movable jaw is moved in a stepwise manner with each step of movement equivalent to one foot operation to pivotally move the lever assembly.

Typically the lever assembly is required to be moved to a predefined extent in order to release the ratchet and cause the next step of movement of the movable jaw.

Typically, when the locking means are unlocked, the reciprocal movement of the lever assembly repeatedly operates the drive means to progressively advance the movable jaw towards the fixed jaw. When the locking means are locked, the movable jaw is retained in position and can apply a selected clamping force within a range of possible clamping forces to the workpiece located between the jaws and without the need for the operator to maintain contact with the lever assembly.

Typically the lever assembly is spring biased to return to its rest position upon release of the lever assembly.

In one embodiment the support structure includes an elongate support body which defines a track along which the carriage with the movable jaw can move towards and away from the fixed jaw. Typically at least three support legs support the body at a fixed distance from a support surface. In one embodiment the support legs, and lever assembly are provided to be movable with respect to the support body between storage and in use conditions and preferably lie substantially in line with the longitudinal axis of the body when in the storage condition.

Typically releasable locks are provided to lock the legs in the in-use position.

In one embodiment the support body includes one or more rollers, wheels or castors to allow the apparatus to be moved with the wheels contacting a support surface at least when the apparatus is in the storage condition.

In one embodiment a handle is provided to allow the apparatus to be carried or the wheeled movement directed by the operator holding the handle.

Typically the lever assembly and locking means operator pedal is located at the end of the support body at which the fixed jaw is located.

In one embodiment the body includes a locating means to allow at least one accessory to be located therewith. In one embodiment the locating means is provided in the form of a first part with a plurality of male and/or female engagement means formed therein for the selective reception of the other of matching male and/or female engagement means provided on a second part.

In one embodiment the first part is provided on the support structure and the second part is provided on the accessory component.

In one embodiment the engagement means allow engagement and disengagement of the parts, and hence engagement of an accessory with the support body, via a sliding movement.

In one embodiment the engagement means are formed as a keyhole female slot and a mushroom pin.

In one embodiment the locating means include a further locating assembly which is movable to a position to prevent the sliding movement of the first and second parts. In one embodiment the locating assembly is biased to the said position.

In one embodiment the locating means is provided as part of, or adjacent to, the fixed jaw at one end of the support body.

In another aspect of the invention there is provided clamping apparatus including two adjustably spaced apart jaws carried by a support structure including a support body in which the first and second clamping jaws are located, means for moving at least one the said jaws relative to the other, fixed jaw and wherein the body includes a locating means to allow at least one accessory component to be located therewith, said locating means provided in the form of a first part provided with the support body with a plurality of male and/or female engagement means formed therein for the selective reception of the other of matching male/or female engagements provided on a second part provided with the accessory component such that the engagement means allow engagement and disengagement of the said parts, and hence the accessory component and support body.

Typically the engagement and disengagement is achieved via relative sliding movement.

Typically the locating means include a further locating assembly which is movable to a position to prevent the sliding movement of the first and second parts. In one embodiment the locating assembly is biased to the said position.

Figure 1B:
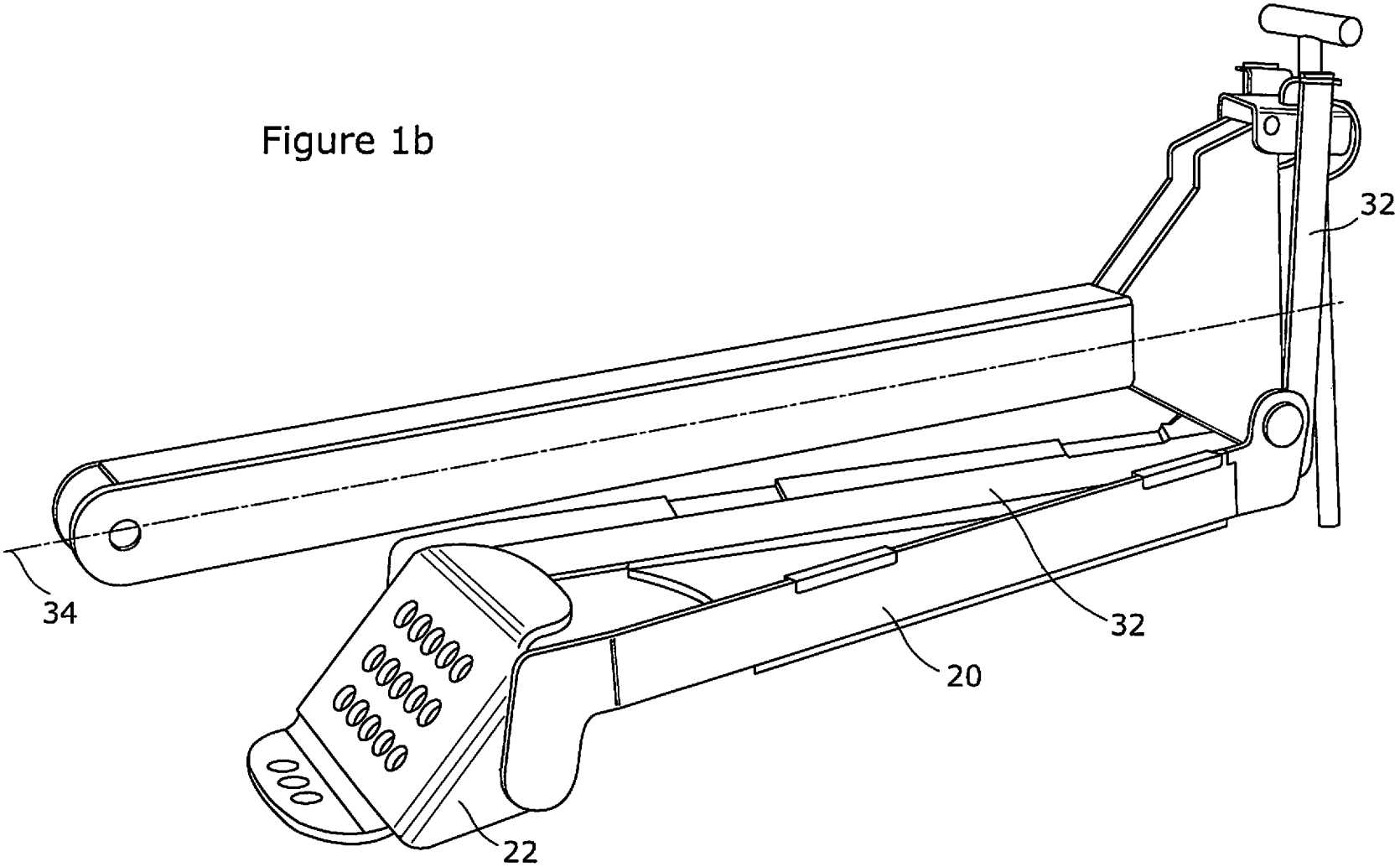
Figure 2A:
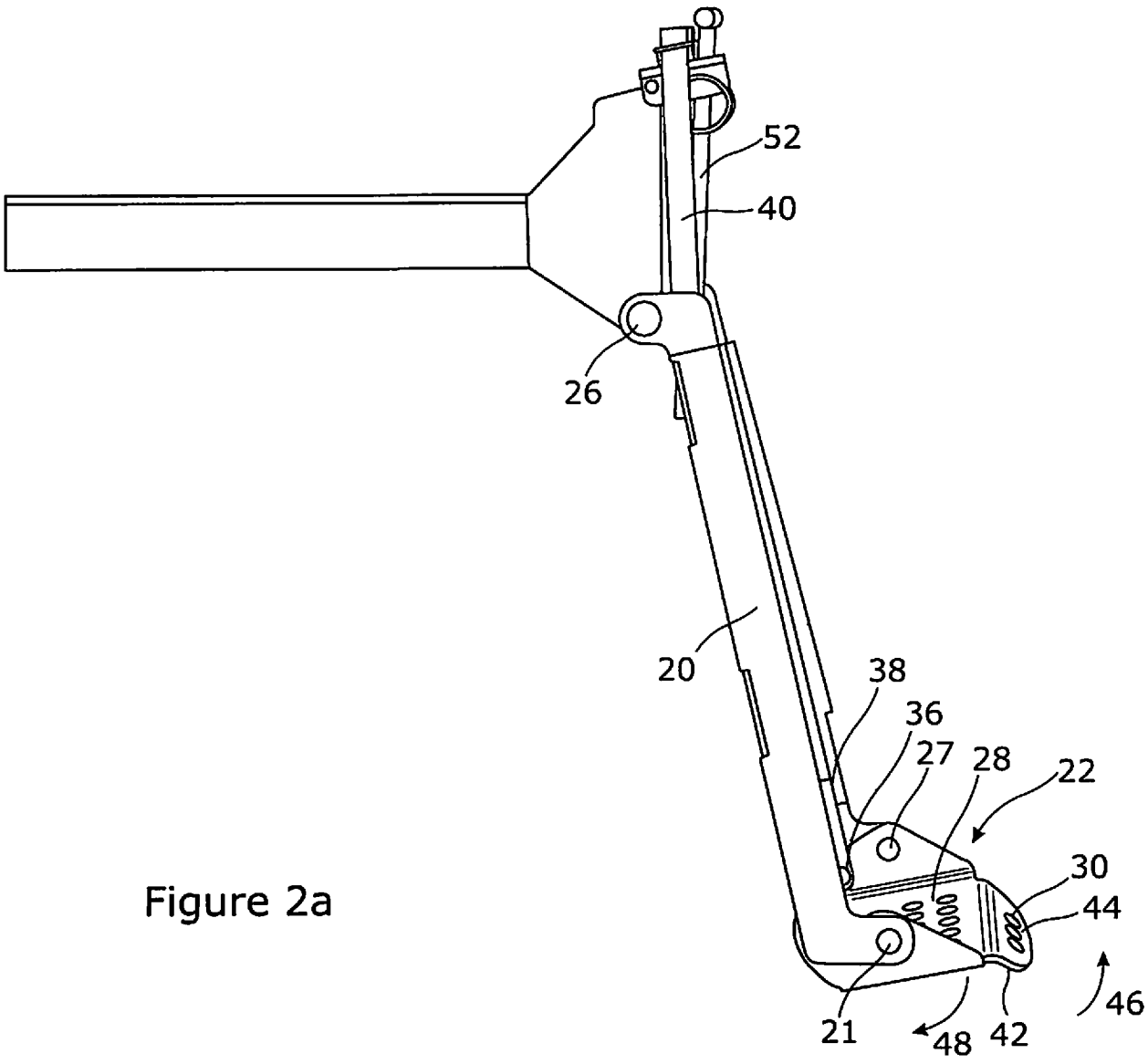
Figure 2B:
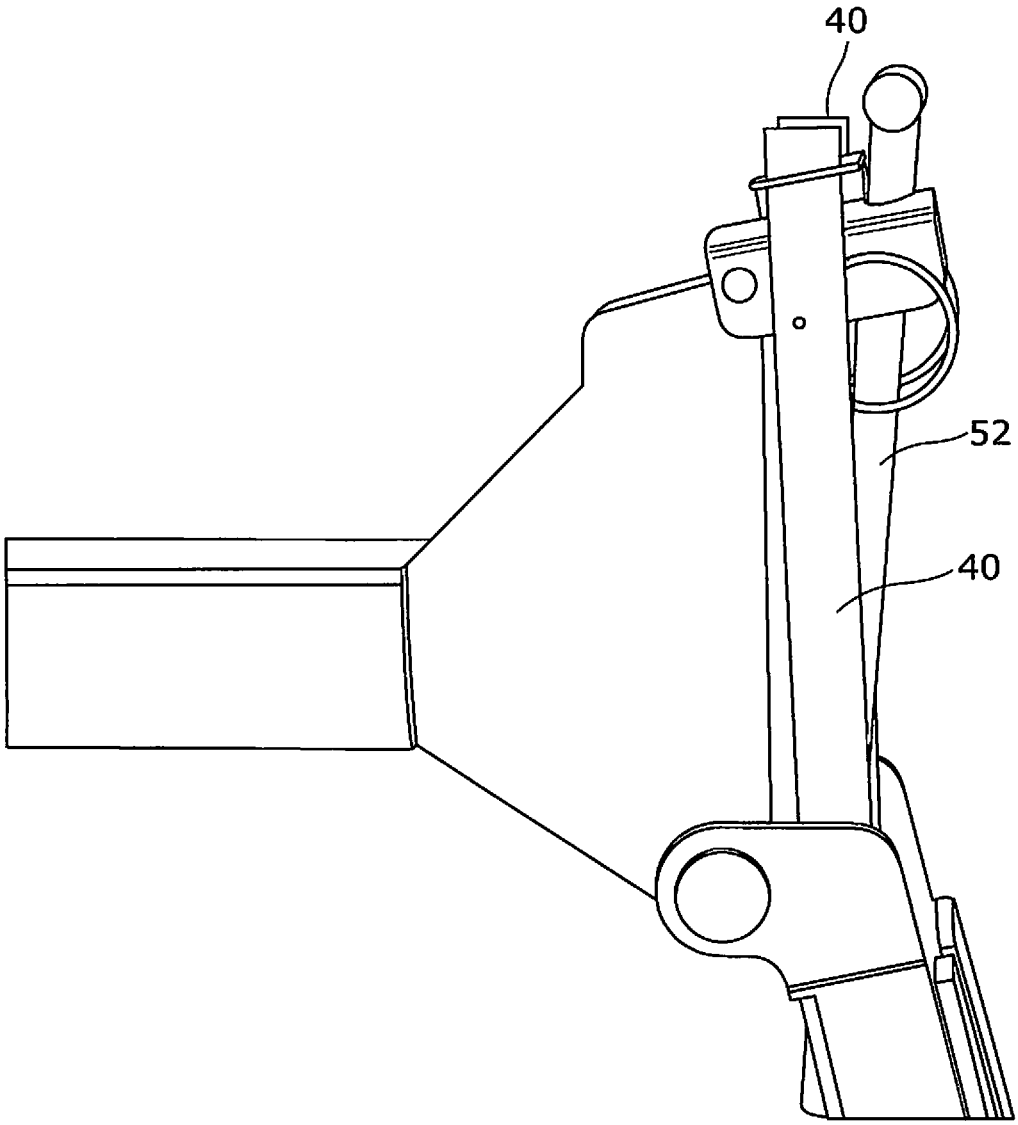
Figure 3A:
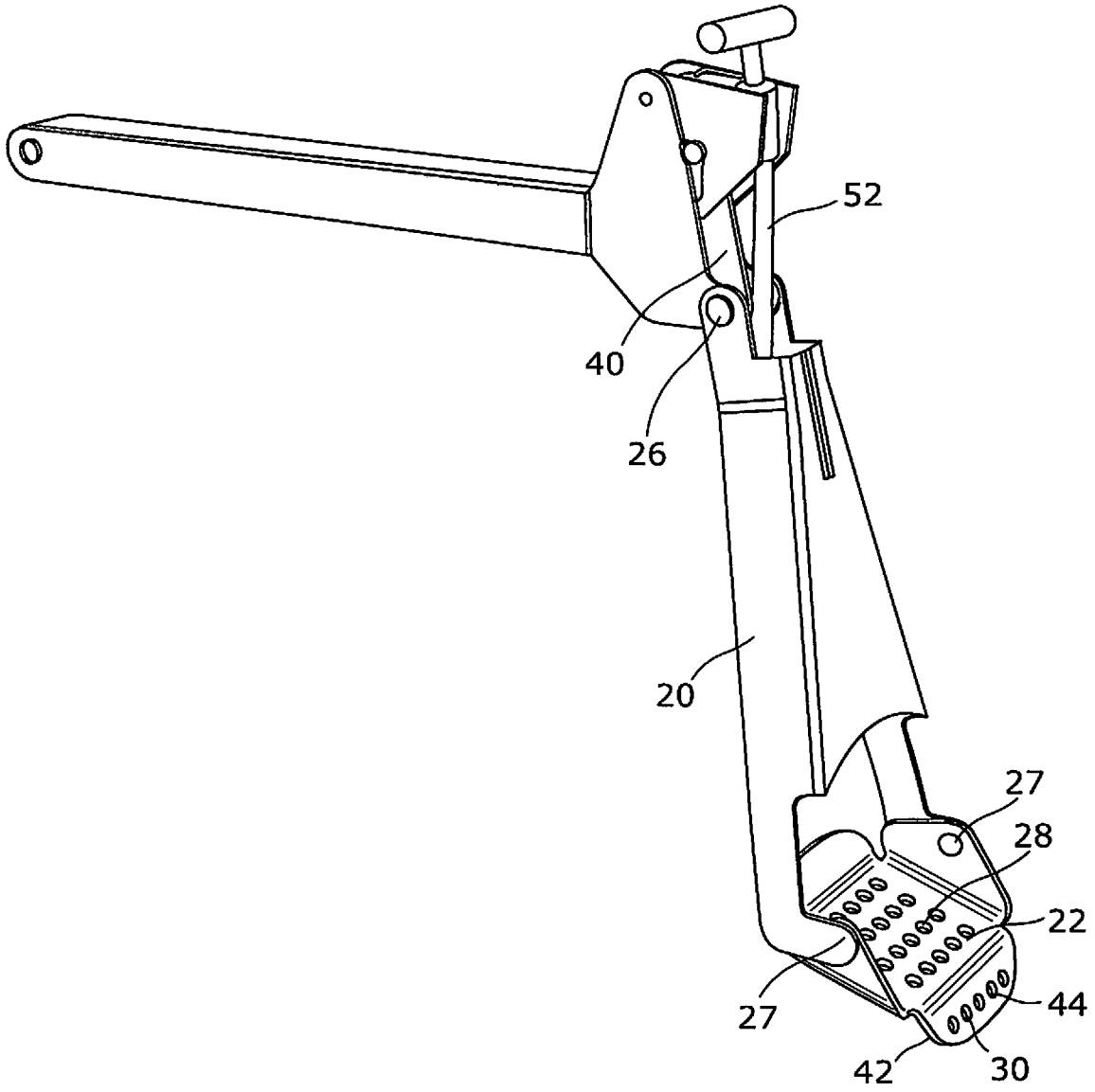
Figure 3B:
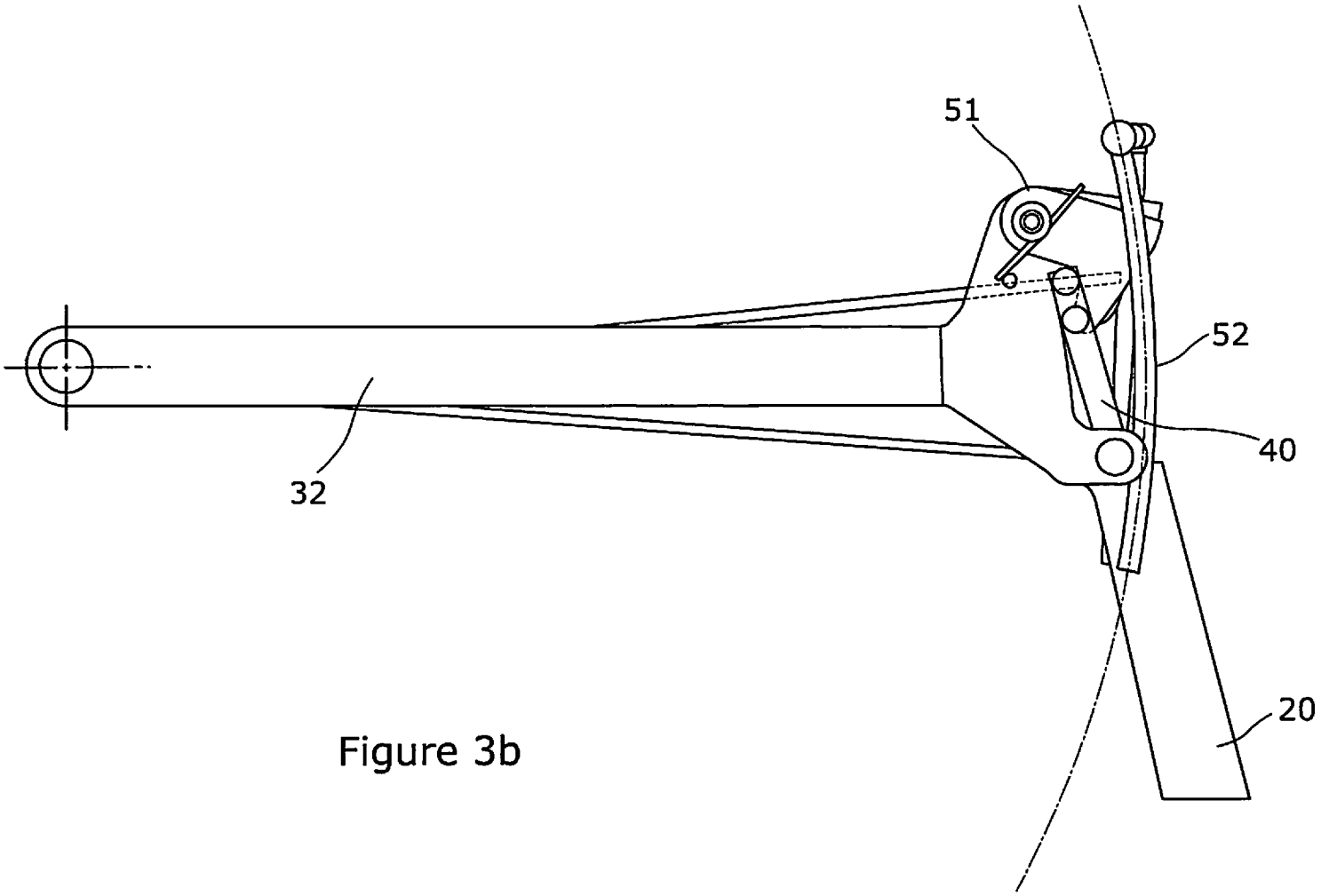

Specific embodiments of the invention are now described with reference to the accompanying drawings; wherein:

FIGS. 1*a-b* illustrate the apparatus in accordance with the invention in an in use condition and part of the apparatus in a storage condition;

FIGS. 2*a-b* illustrate the locking means in accordance with one embodiment of the invention;

FIGS. 3*a-b* illustrate the locking means in accordance with another embodiment of the invention; and FIGS. 4*a-e* illustrate locating means in accordance with one embodiment of the invention.

Referring firstly to FIG. 1*a*, there is illustrated clamping apparatus of the form to which the invention relates. The apparatus 2 includes a support body 4 which incorporates an integral track 6 and a fixed jaw 8. A movable jaw and carriage assembly 10 is provided, with the movable jaw upstanding and substantially parallel with the fixed jaw and the carriage is substantially n-shaped and receives the track 6 therein so that the movable jaw and carriage assembly is located on the track 6 for movement there along. The support body is located at a fixed distance from the support surface 12 by legs 14, 16, 18 which can be moved between the in use condition shown and pivoted with respect to the support body 4 to a storage condition in which the same lie substantially in line with the elongate support body 4. FIG. 1*b* shows the provision of the lever assembly 20 and locking means 32 in a storage condition with respect to the longitudinal axis 34 of the support body and the legs 14, 16, 18

(not shown) would also lie substantially parallel to the longitudinal axis 34 in the storage condition.

The movement of the jaw and carriage assembly 10 is achieved by operator foot operation of a lever assembly 20 which includes a foot pedal 22 at the end 24 of the assembly and the assembly is pivotally located at pivot 26 to the support body 4.

The operation of the lever assembly 20 via the foot pedal 22 is achieved by the operator placing their foot in contact with the portion 28 of the pedal and moving the foot pedal 22 and hence lever assembly 20 forwards and backwards as indicated by arrow 25. This movement is translated through the pivot points 27 which connect the pedal to the lever assembly and by the lever assembly via pivot 26 and in turn to a ratchet mechanism to which the movable jaw and carriage assembly 10 are connected so as to provide an advancing movement action on the movable jaw and carriage assembly 10 so as to move the same towards the fixed jaw 8 in the direction of arrow 11. The movement is translated to the carriage from the support body, in one embodiment, by the lever assembly including a series of movable teeth on the support body track which are reciprocally linearly movable under the influence of the movement of the lever assembly. The teeth progressively engage with sets of apertures of a series of apertures formed in a linear path along the underside of the carriage such that engagement of the teeth with a first set of apertures located above the teeth, moves the carriage when the teeth are moved by the lever assembly. The teeth then engage with a new set of apertures which are now located above the teeth and move the carriage again, and this is repeated as required with each cycle of movement of the lever assembly. This allows the progressive movement of the carriage and movable jaw thereon, towards the fixed jaw as the lever assembly is moved.

The jaws 8 and 10 define a space 15 therebetween and into which a workpiece 64 is placed and the jaw 10 is then moved to contact the workpiece and, in conjunction with jaw 8, clamp the workpiece in position. Typically each movement of the lever assembly for a predetermined distance by the operators foot will cause a step movement of the movable jaw and carriage assembly 10 towards the fixed jaw. When the movable jaw 10 is in the required position and the required clamping force is applied, the position of the movable jaw 10 can be locked using a locking means in the manner as now described.

FIG. 1*a* and FIGS. 2*a* and *b* illustrate the lever assembly 20 and locking means 32 of the apparatus in accordance with one embodiment of the invention in more detail.

In accordance with the invention, the foot pedal 22 of the lever assembly, in addition to including the portion 28 for contact by the operator's foot to cause the pivotal movement of the lever assembly 20 with respect to the support body 4 and hence the movement of the movable jaw and carriage assembly 10, also includes a locking means actuator portion 30 and the foot pedal is also pivotally connected 36 with members 38 and 40 provided as part of the locking means which, when in a locking position, prevent the movement of the lever assembly and hence prevent the provision of a moving force on the movable jaw and carriage assembly 10 and hence maintain the same in the fixed locked position and maintain the clamping force which is being applied to a workpiece at that time. The operator will typically operate the locking means when the two jaws are in position clamping the workpiece between the same and sufficient clamping force is being applied so as to maintain the workpiece in position without the operator having to hold the workpiece with their hands. As such, and as the locking means can be foot operated as well, both of the operators hands are free to perform the work on the workpiece at all times.

The locking means actuation portion 30 of the foot pedal has a first, under, surface 42 and a second, opposing, top surface 44. The under surface 42 is provided to be selectively contacted by the toes of the foot of the operator and thereby flipped or moved upwardly as indicated by arrow 46 and this causes the locking means to be moved to a locked position and hence lock the jaw 10 in position. The top surface 44 is provided to be selectively moved by contact with the heel of the operator's foot and moved downwardly as indicated by arrow 48 to move the locking means to the unlocking position and hence allow the jaw 10 to be free to be moved.

FIGS. 3*a-b* illustrate a second embodiment of the locking means using the same reference numerals and it will be appreciated that in both cases the operation of the locking means is achieved utilising the foot operation of the locking means via the pedal 22 portion 30 as described.

In both embodiments, the locking means include a locking shaft 52 and actuator members which are moved under the influence of the movement of the pedal. The actuator members 38, 40 act on a lock plate to allow the same to be moved between locking and unlocking positions with respect to the lock shaft and so, in turn prevent the movement of the movable jaw 10 when the locking means is in the locked position and, when released, movement of the jaw 10 is again possible. Said members 38, 40 and locking plate act to prevent movement of the jaw by preventing pivotal movement of the lever assembly when the locking means are engaged.

There is therefore provided the possibility of hands free operation of the movement of the movable jaw as well as the locking and unlocking of the movement mechanism for the same.

Turning now to FIGS. 4*a-e*, there is illustrated an embodiment of the apparatus in which locating means for an accessory component can be provided in accordance with the invention. The accessory may be provided to allow another work action to be performed using the apparatus or may be to allow a particular function of the apparatus to be adapted.

Figure 4A:
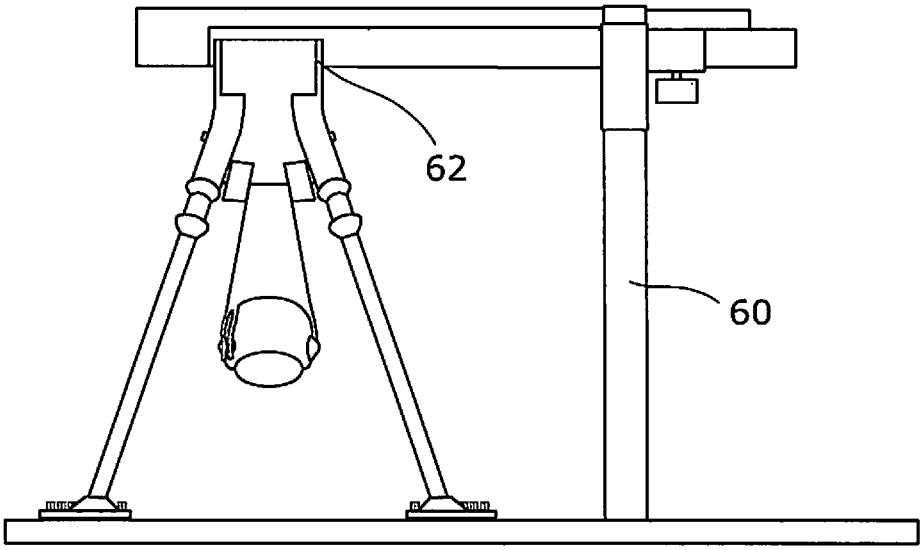
Figure 4B:
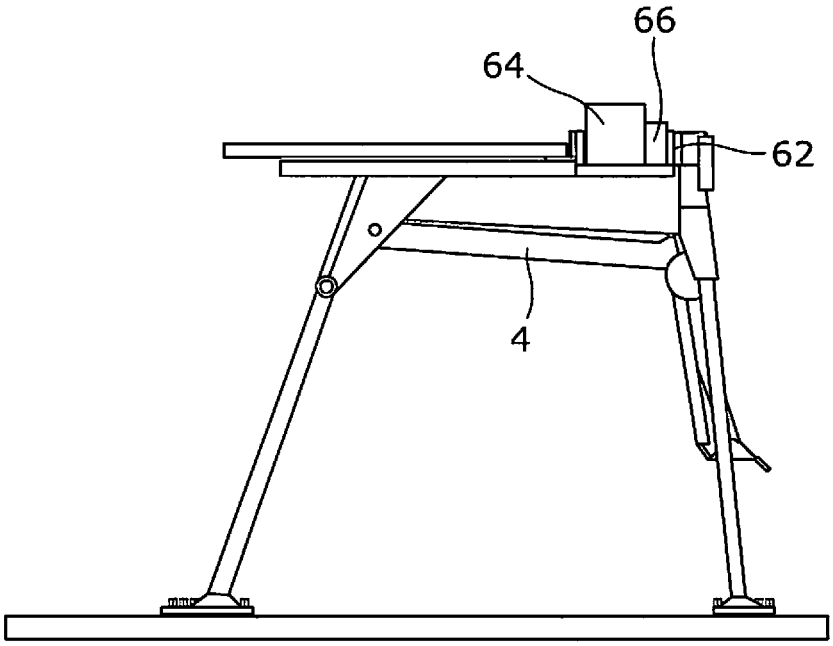
Figure 4C:
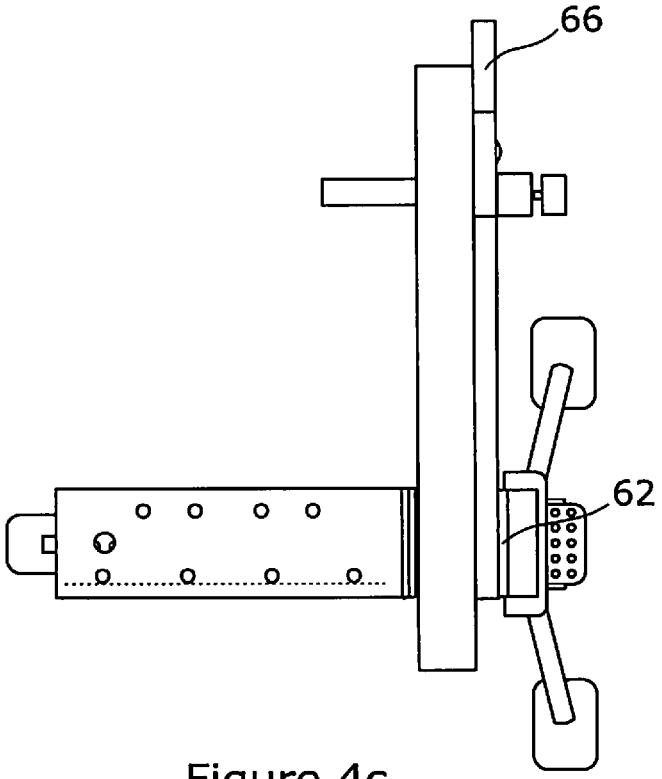

In FIGS. 4*a-c* there is illustrated an accessory component in the form of a support 66 for a workpiece in the form of a plank 64. At one end there is provided a stand 60 which is clamped to the plank and the stand is located at a spaced distance from the apparatus 2. At the support body 4 there is provided a locating means 62 in accordance with the invention. The locating means is provided, in this example, to engage with a baton 66 which is provided as part of the accessory and is also attached to the stand 60.

Figure 4D:
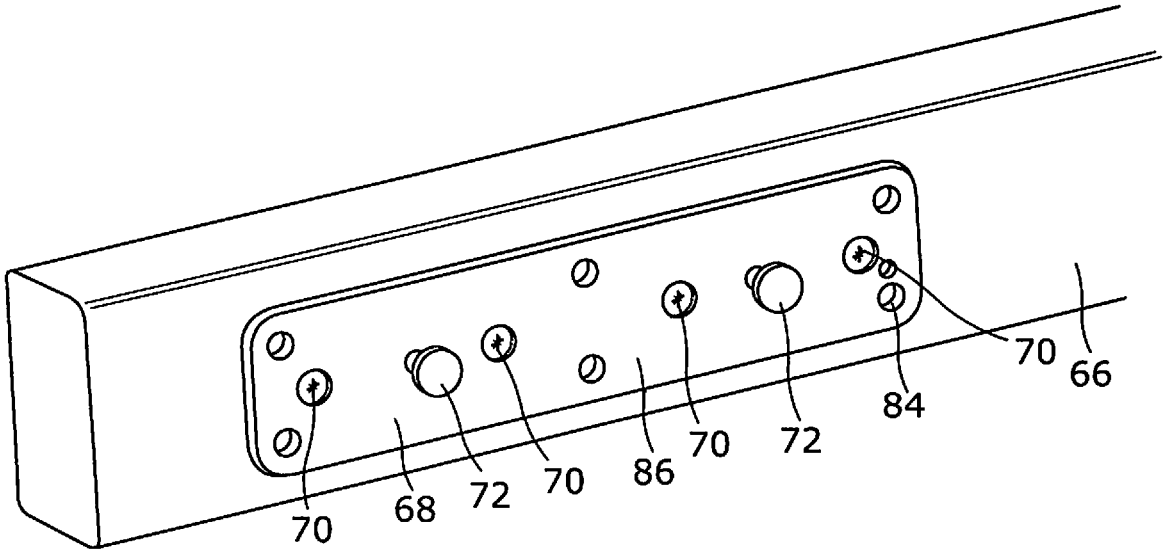

The baton 66 is shown in more detail in FIG. 4*d* and one part 68 of the location means is illustrated as a plate which, in this example, is attached by screws 70 in a fixed position on the baton. The location means 68 includes male engagement pins 72 which are mushroom shaped as shown. The locating means plate 68 also includes an aperture 84.

Figure 4E:
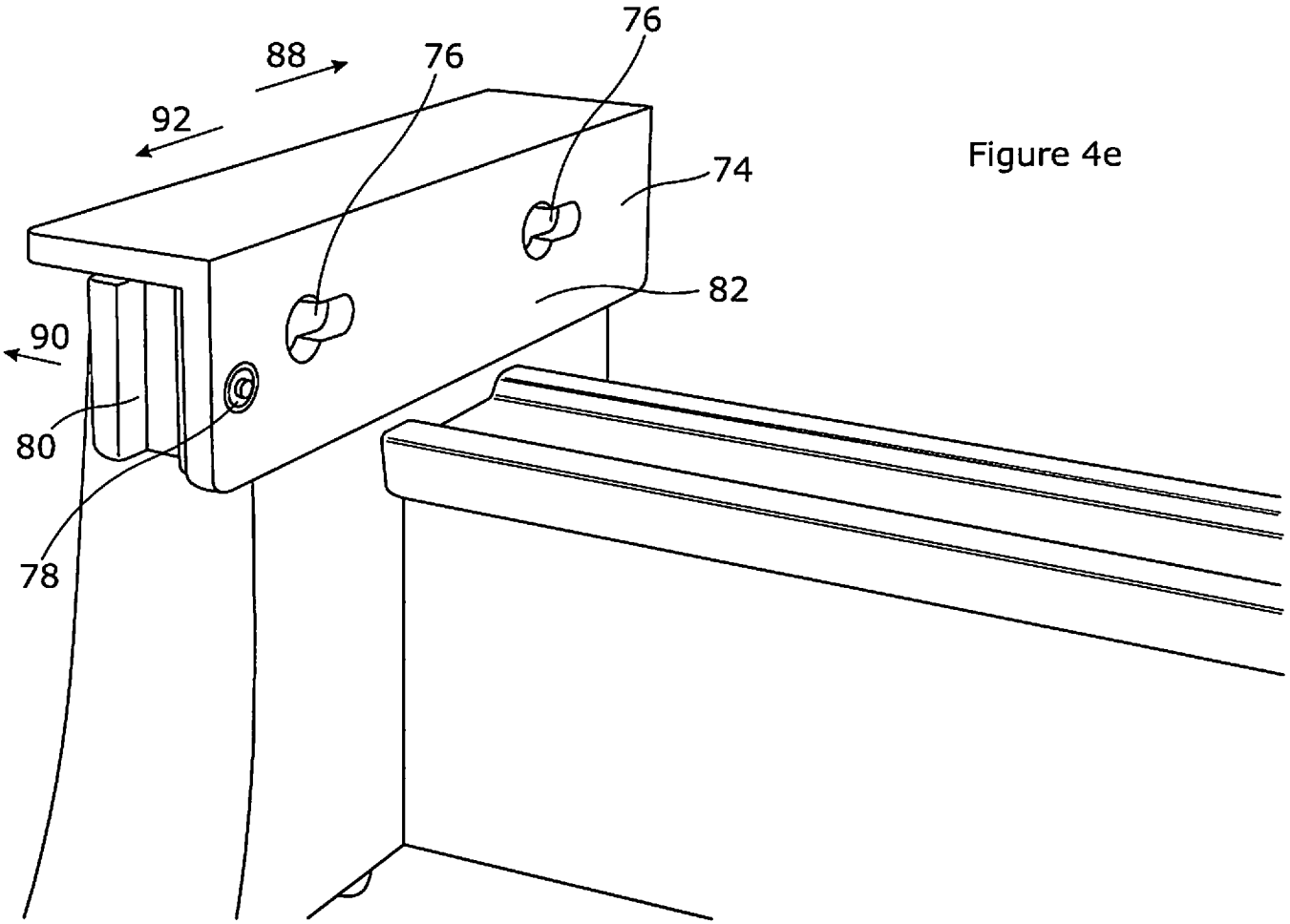

The second part 74 of the locating means is illustrated in FIG. 4*e*. This part 74 is provided at the end of the support body at which the fixed jaw 8 is located. This part includes matching female key hole slots 76 for the reception of the pins 72. There is also provided a pin 78 which is to be received in the aperture 84 of the part 68 and the pin passes through a channel in the second part 74 from the locating assembly 80 and is biased to protrude outwardly of the surface 82.

In order to engage the two parts 68, 74 of the locating means, the surfaces 86 and 82 of the respective parts are brought together so that the pins 72 of part 68 move into the head portion of the respective keyhole slots 76 of part 74. This movement of the surfaces towards each other also causes the pin 78 to be moved against the biasing force of a spring in the locating assembly 80 and lie substantially flush with the surface 82.

With the pins 72 in the respective keyhole slots 76, relative sliding movement of the part 68 in direction of arrow 88 shown in FIG. 4*e* moves the pins 72 into the narrower section of the keyhole slots 76 and, when the pins 72 are fully in position, the aperture 84 in the part 68 will be in line with the pin 78 in part 74 such that the pin 78 is then free to move under the influence of the spring in the assembly 80 and protrude into the aperture 84 and lock the two parts 68, 74 in position to prevent sliding movement.

To release the parts 68, 74 the assembly 80 is gripped and moved in the direction 90 to move the pin 78 out of the aperture 84 and allow the sliding movement of the parts 68, 74 in direction 92.

Thus there is provided in accordance with the invention a clamping apparatus which allows improved ease and safety of operation of the same to position a workpiece with a clamping force for work to be performed thereon. The invention also provides for the location and use of a range of accessory components to be selectively located on the apparatus for use in relation to specific work requirements.

The invention claimed is:

1. A clamping apparatus, said clamping apparatus comprising:

a support structure;

at least two clamping jaws, at least one of the jaws linearly moveable with respect to the other jaws to define a spacing between the jaws within which a workpiece is held in position by the at least two clamping jaws;

a lever assembly pivotally connected to the support structure and provided to be pivotally moved by an operator for engaging and driving movement of the linearly moveable jaw to apply a clamping force to the workpiece positioned between the at least two clamping jaws; and locking means for locking the linearly moveable jaw in an operator selected position, and wherein the locking means is actuable by the operator contacting a locking means actuator via a foot of the operator said locking means actuator connected to and formed as a portion located at an edge of a pedal provided and connected to operate the lever assembly, and said portion includes a first surface to be acted upon by the operator's foot to move the same in a first direction to lock the locking means and a second surface to be acted upon by the operator's foot to move the same in an opposite direction to release the locking means, and the locking means actuator is connected to the locking means via first and second members with which the pedal is connected and which are selectively movable independently of the lever assembly.

2. Apparatus according to claim 1 wherein the locking means actuator is pivotally movable with respect to the lever assembly to allow selective locking of a position of the linearly movable jaw when the locking means actuator is moved in a first direction and an unlocking position of the linearly movable jaw when the locking means actuator is moved in a second direction.

3. Apparatus according to claim 2 wherein the second direction is opposite to the first direction.

4. Apparatus according to claim 1 wherein the first and second members and locking means prevent pivotal movement of the lever assembly when the locking means are engaged.

5. Apparatus according to claim 1 wherein when the locking means are unlocked, reciprocal movement of the lever assembly repeatedly operates drive means to progressively advance the linearly movable jaw towards a fixed jaw.

6. Apparatus according to claim 1 wherein the support structure includes an elongate support body in which is defined a track with respect to which the linearly movable jaw is moved towards and away from a fixed jaw.

7. Apparatus according to claim 6 wherein the linearly movable jaw is provided as part of a carriage which is movable with respect to the support body.

8. Apparatus according to claim 7 wherein each cycle of movement of the lever assembly progressively moves the carriage, and movable jaw thereon, towards the fixed jaw as the lever assembly is moved.

9. Apparatus according to claim 7 wherein the support body track is housed within the carriage.

10. Apparatus according to claim 6 wherein at least three support legs support the elongate support body at a fixed distance from a support surface and the at least three support legs and lever assembly are provided to be movable with respect to the support body between storage and in-use conditions.

11. Apparatus according to claim 6 wherein the elongate support body includes a locating means to allow at least one accessory component to be located therewith.

12. Apparatus according to claim 11 wherein the locating means is provided in the form of a first part with a plurality of male and/or female engagement means formed therein for the selective reception of the other matching male and/or female engagement means provided on a second part.

13. Apparatus according to claim 12 wherein the engagement means allow engagement and disengagement of an accessory component with the support body via a sliding movement.

14. Apparatus according to claim 13 wherein the locating means include a further locating assembly which is movable to a position to prevent the sliding movement of the first and second parts.

15. Apparatus according to claim 14 wherein the locating assembly is biased to the position.

16. Apparatus according to claim 1 wherein the lever assembly and locking means are located at an end of a support body at which a fixed jaw is located.

17. A clamping apparatus, said apparatus comprising:

two adjustably spaced apart jaws carried by a support structure including a support body in which first and second clamping jaws are located, movement means for moving at least one of the jaws relative to another jaw which is in a fixed position on the support body, and the support body includes a locating means to allow at least one accessory component to be located therewith, and wherein said locating means provided in a form of a first part provided with the support body with a plurality of male and/or female engagement means formed therein for selective reception of another of matching male/or female engagements provided on a second part provided with the at least one accessory component such that the engagement means allow engagement and disengagement of the first and second parts, said movement of the at least one of the jaws achieved by user operation of a lever assembly and a locking means is selectively actuable to lock the position of the at least one of the jaws and wherein the locking means is actuable by the operator contacting a locking means actuator via their foot, said locking means actuator connected to and formed integrally with a pedal provided to operate the lever assembly and said locking means actuator includes a first surface to be acted upon by the operator's foot to move the locking means actuator in a first direction to lock the locking means and a second surface to be acted upon by the operator's foot to move the locking means actuator in an opposite direction to release the locking means, and the locking means actuator is connected to the locking means via first and second members with which the pedal is connected and which are selectively moveable independently of the lever assembly.

18. Apparatus according to claim 17 wherein the engagement and disengagement is achieved via relative sliding movement.

19. Apparatus according to claim 18 wherein the locating means include a further locating assembly which is movable to a position to prevent the sliding movement of the first and second parts.

20. Apparatus according to claim 19 wherein the locating assembly is biased to the position.

* * * * *